US010036189B2

(12) United States Patent
Chen et al.

(10) Patent No.: US 10,036,189 B2
(45) Date of Patent: Jul. 31, 2018

(54) SYNCHRONOUS HINGE DEVICE

(71) Applicant: LIANHONG ART CO., LTD., Taoyuan (TW)

(72) Inventors: Chia-Hui Chen, Taoyuan (TW); Tzu-Yu Lin, Taoyuan (TW); Yen-Ting Chen, Taoyuang (TW)

(73) Assignee: LIANHONG ART CO., LTD., Taoyuan (TW)

( * ) Notice: Subject to any disclaimer, the term of this patent is extended or adjusted under 35 U.S.C. 154(b) by 252 days.

(21) Appl. No.: 14/981,904

(22) Filed: Dec. 28, 2015

(65) Prior Publication Data

US 2017/0183895 A1 Jun. 29, 2017

(51) Int. Cl.

| | |
|---|---|
| ***E05D 3/06*** | (2006.01) |
| ***E05D 3/14*** | (2006.01) |
| ***E05D 11/08*** | (2006.01) |

(52) U.S. Cl.

CPC ..... *E05D 3/14* (2013.01); *E05D 11/082* (2013.01)

(58) Field of Classification Search

CPC ..... E05D 3/14; E05Y 2201/62; Y10T 16/547; Y10T 16/5474; Y10T 16/5475; Y10T 16/5476; Y10T 16/53832; Y10T 16/53833; Y10T 16/53864; Y10T 16/5387

See application file for complete search history.

(56) References Cited

U.S. PATENT DOCUMENTS

| | | | | | |
|---|---|---|---|---|---|
| 862,550 | A * | 8/1907 | Gardner | E05D 3/14 | 16/370 |
| 1,387,962 | A * | 8/1921 | Baerwaldt | E05D 3/14 | 16/253 |
| 2,130,663 | A * | 9/1938 | Baker | E05D 3/14 | 16/370 |
| RE30,475 | E * | 1/1981 | Heinze, Sr. | E05D 3/142 | 16/246 |
| 4,534,079 | A * | 8/1985 | Tucker | E01D 15/124 | 14/14 |
| 7,054,147 | B2 * | 5/2006 | Maatta et al. | G06F 1/1616 | 16/368 |
| 7,328,481 | B2 * | 2/2008 | Barnett | E05D 3/08 | 16/227 |
| 7,469,448 | B1 * | 12/2008 | Forester | E05D 3/14 | 16/366 |

(Continued)

*Primary Examiner* — Victor D Batson
*Assistant Examiner* — Matthew J Sullivan
(74) *Attorney, Agent, or Firm* — Guice Patents PLLC

(57) ABSTRACT

A synchronous hinge device includes a first base having a first connecting portion and a first assembling portion. The first connecting portion has a first central groove, a first outer groove, a first through hole and a second through hole. A second base has a second connecting portion and a second assembling portion. The second connecting portion has a second central groove, a second outer groove, a third through hole and a fourth through hole. First, second, third, and forth shafts extending through the first, the second, the third, and the fourth through holes, respectively. A first torque element disposed between the first shaft and the third shaft; and a second torque element disposed between second shaft and the fourth shaft, wherein the first torque element has axle sleeves limiting the first distance, and the second torque element has axle sleeves limiting the second distance.

7 Claims, 9 Drawing Sheets

(56) References Cited

U.S. PATENT DOCUMENTS

| | | | | |
|---|---|---|---|---|
| 8,869,353 | B2 * | 10/2014 | Hsu | E05D 3/14 16/364 |
| 8,959,719 | B2 * | 2/2015 | Hsu | G06F 1/1618 16/303 |
| 9,268,372 | B1 * | 2/2016 | Hsu | G06F 1/1681 |
| 9,523,225 | B2 * | 12/2016 | Smith | E05D 3/147 |
| 2008/0216288 | A1 * | 9/2008 | Hoffman | E05D 3/127 16/354 |
| 2017/0254127 | A1 * | 9/2017 | Uchiyama | E05D 3/14 |

* cited by examiner

SYNCHRONOUS HINGE DEVICE

BACKGROUND OF THE INVENTION

Field of the Invention

The invention relates to a synchronous hinge device, wherein torque elements with axle sleeves are disposed between two bases to limit axle distance and form a particular geometry constrain structure which causes the two bases to move synchronously.

Description of the Related Art

A conventional laptop usually includes a main body and a display device rotatably connected to the main body through a hinge device disposed between the main body and the display device. In another type of laptop, the display device can be positioned at any angle through a double shaft hinge device for operation.

The double shaft hinge device includes a first shaft rotated with the display device and a second shaft rotated with the main body. When the display device is rotated to a desired angle with respect to the main body for operation, torque elements and positioning mechanisms are often necessary to position the display device at any angle.

A conventional double shaft hinge device includes torque positioning elements disposed on the two shafts. The torque positioning elements includes concave wheels, convex wheels and a plurality of torque pads. The torque elements are disposed on the shafts and positioned thereon through nuts screwed to the shafts. However, such conventional double shaft hinge devices use large amount of the torque elements, which take much labor and time for assembly.

BRIEF SUMMARY OF THE INVENTION

The invention provides a synchronous hinge device. The synchronous hinge device includes two shafts rotating synchronously through geometry constrain. A display device of a laptop using the synchronous hinge device of the invention can rotate and be positioned at any angle with respect to a main body of the laptop. The synchronous hinge device in accordance with an exemplary embodiment of the invention includes a first base comprising a first connecting portion and a first assembling portion, the first connecting portion comprises a first central groove, a first outer groove, a first through hole and a second through hole, the first through hole and the second through hole are formed between the first central groove and the first outer groove; a second base comprising a second connecting portion and a second assembling portion, the second connecting portion comprises a second central groove, a second outer groove, a third through hole and a fourth through hole, the third through hole and the fourth through hole are formed between the second central groove and the second outer groove; a first shaft extending through the first through hole; a second shaft extending through the second through hole; a third shaft extending through the third through hole; a fourth shaft extending through the fourth through hole; a first torque element disposed between the first shaft and the third shaft and corresponding to a first distance between the first and third shafts; and a second torque element disposed between second shaft and the fourth shaft and corresponding to a second distance between the second and fourth shafts, wherein the first torque element comprises axle sleeves limiting the first distance and so as to synchronously move the first base and the second base, and the second torque element comprises axle sleeves limiting the second distance and so as to synchronously move the first base and the second base.

In another exemplary embodiment, the axle sleeves are formed at two ends of the first and second torque elements and have a curved shape and a notch.

In yet another exemplary embodiment, the first shaft, the second shaft, the third shaft and the fourth shaft have different radial length in a predetermined position.

In another exemplary embodiment, each of the first shaft, the second shaft, the third shaft and the fourth shaft has an upper cut plane and a lower cut plane, a distance between the upper cut plane and the lower cut plane is less than the radial length of an outer periphery thereof, and at least one of the first through hole, the second through hole, the third through hole and the fourth through hole has a cross section the same as a cross section of one of the first shaft, the second shaft, the third shaft and the fourth shaft.

In yet another exemplary embodiment, each of the first torque element and the second torque element comprises a plurality of closed sealing sheets, and each of the closed sealing sheets comprises two separated through holes and a groove connecting the separated through holes.

In another exemplary embodiment, each of the first torque element and the second torque element comprises a plurality of opened sealing sheets, and each of the opened sealing sheets comprises two separated through holes connecting to an outer edge thereof.

In yet another exemplary embodiment, each of the first torque element and the second torque element comprises a plurality of closed sealing sheets and a plurality of opened sealing sheets, each of the closed sealing sheets comprises two separated through holes and a groove connecting the separated through holes, and each of the opened sealing sheets comprises two separated through holes connecting to an outer edge thereof.

The synchronous hinge device in accordance with another exemplary embodiment of the invention includes a first base comprising a first connecting portion and a first assembling portion, the first connecting portion comprises a first central groove, a first outer groove, a first through hole and a second through hole, the first through hole and the second through hole are formed between the first central groove and the first outer groove; a second base comprising a second connecting portion and a second assembling portion, the second connecting portion comprises a second central groove, a second outer groove, a third through hole and a fourth through hole, the third through hole and the fourth through hole are formed between the second central groove and the second outer groove; a first shaft extending through the first through hole; a second shaft extending through the second through hole; a third shaft extending through the third through hole; a fourth shaft extending through the fourth through hole; a torque element disposed in the first central groove and the second central groove and connecting the second shaft and the fourth shaft; two links disposed in the first outer groove and the second outer groove and connecting the first shaft and the third shaft.

In another exemplary embodiment, the torque element comprises two axle sleeves formed at two ends thereof, and the axle sleeves are formed at two ends of the first and second torque elements and have a curved shape and a notch.

A detailed description is given in the following embodiments with reference to the accompanying drawings.

BRIEF DESCRIPTION OF THE DRAWINGS

The invention can be more fully understood by reading the subsequent detailed description and examples with references made to the accompanying drawings, wherein.

DETAILED DESCRIPTION OF THE INVENTION

Figure 1:
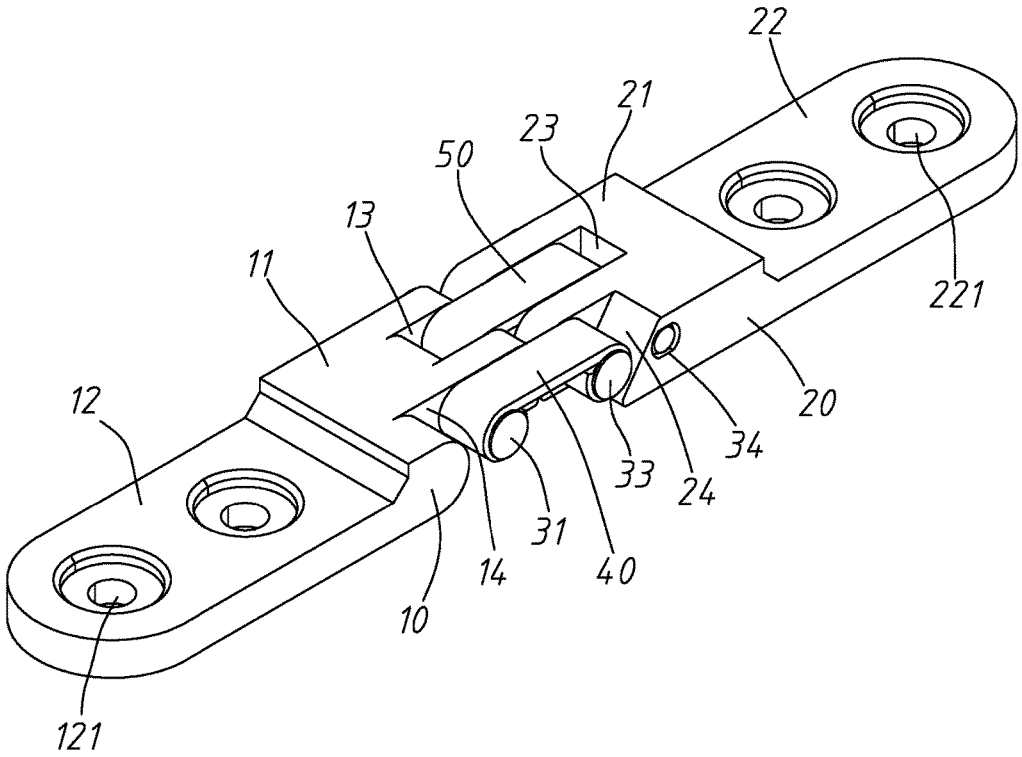
FIG. 1 is a perspective view of an embodiment of a synchronous hinge device of the invention.

The following description is of the best-contemplated mode of carrying out the invention. This description is made for the purpose of illustrating the general principles of the invention and should not be taken in a limiting sense. The scope of the invention is best determined by reference to the appended claims.

Referring to FIGS. 1 to 4, a synchronous hinge device of the invention includes a first base 10 and a second base 20. The first base 10 includes a first connecting portion 11 and a first assembling portion 12, and the second base 20 includes a second connecting portion 21 and a second assembling portion 22. The first connecting portion 11 includes a first central groove 13 and a first outer groove 14, and the second connecting portion 21 includes a second central groove 23 and a second outer groove 24. A first through hole 15, a second through hole 16, a third through hole 17 and a fourth through hole 18 are formed between the first central groove 13, the second central groove 23 and the first outer groove 14 and the second outer groove 24. A first shaft 31 extends through the first through hole 15, a second shaft 32 extends through the second through hole 16, a third shaft 33 extends through the third through hole 17 and a fourth shaft 34 extends through the fourth through hole 18. The first assembling portion 12 includes a through hole 121, and the second assembling portion 22 includes a through hole 221. The through holes 121 and 221 can be joined to a display device and a main body of an electronic device (not shown).

A first torque element 40 is disposed between the first shaft 31 and the third shaft 33 and corresponds to a distance between the first shaft 31 and the third shaft 33, and a second torque element 50 is disposed between the second shaft 32 and the fourth shaft 34 and corresponds to a distance between the second shaft 32 and the fourth shaft 34. The first torque element 40 includes two axle sleeves 41 and 42 formed at two ends thereof and holding the first shaft 31 and the third shaft 33. The axle sleeves 41 and 42 have curved shape and have a notch. The second torque element 50 includes two axle sleeves 51 and 52 formed at two ends thereof and holding the second shaft 32 and the fourth shaft 34. Each of the axle sleeves 41 and 42 has a curved shape and a notch, and each of the axle sleeves 51 and 52 has a curved shape and a notch. Since the axle sleeves 41 and 42 holds the first shaft 31 and the third shaft 33 and the axle sleeves 51 and 52 holds the second shaft 32 and the fourth shaft 34, the first torque element 40 limits the distance between the first shaft 31 and the third shaft 33 and the second torque element 50 limits the distance between the second shaft 32 and the fourth shaft 34, whereby the first base 10 and the second base 20 are moved synchronously due to geometry constrain.

Figure 2:
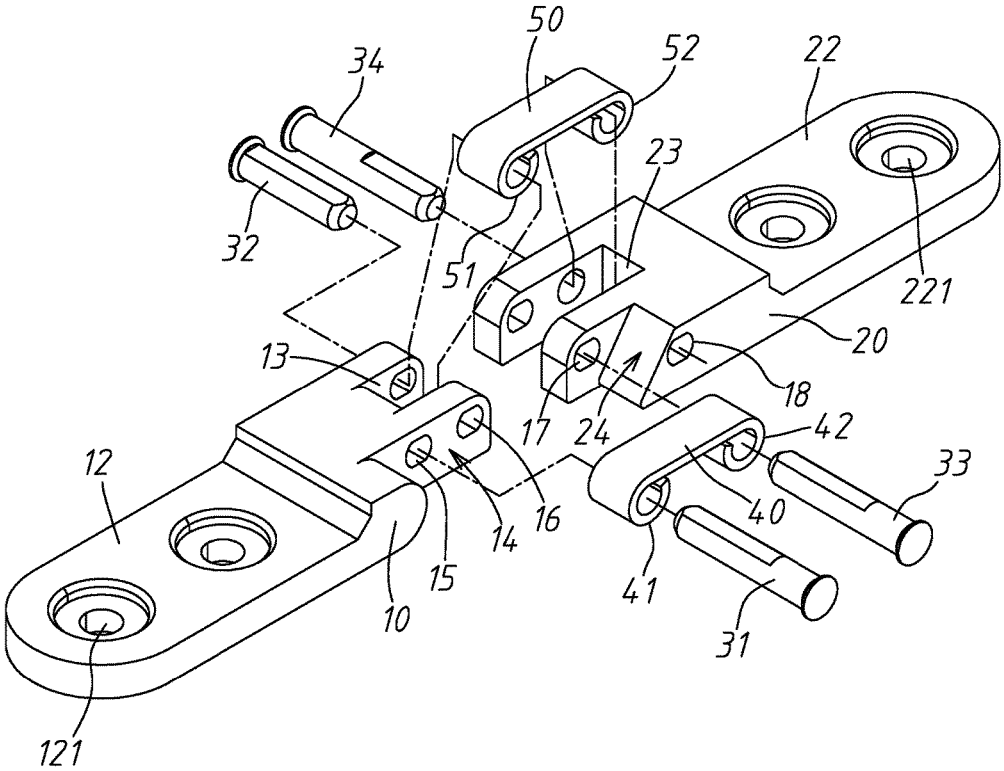
FIG. 2 is an exploded view of FIG. 1.
Figure 4:
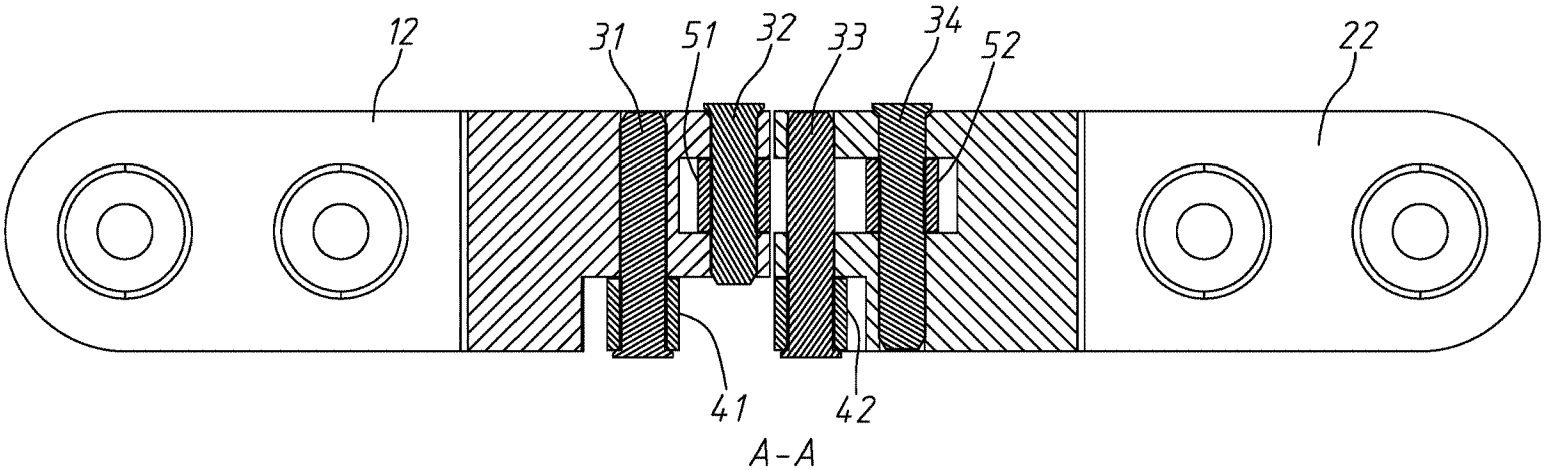
FIG. 4 is a cross section of FIG. 3 along a line A-A.

The first shaft 31, the second shaft 32, the third shaft 33 and the fourth shaft 34 have different radial length in a position of their shaft body. As shown in FIG. 2, each of the first shaft 31, the second shaft 32, the third shaft 33 and the fourth shaft 34 has an upper cut plane and a lower cut plane formed on their shaft body, and a radial distance between the upper cut plane and the lower cut plane is less than the radial length of an outer periphery of the shaft body. As the first shaft 31, the second shaft 32, the third shaft 33 and the fourth shaft 34 rotate with respect to the first base 10 and the second base 20 to positions of different radial length, their shaft bodies press the axle sleeves 41, 42, 51 and 52 to generate torque for positioning. At least one of the first through hole 15, the second through hole 16, the third through hole 17 and the fourth through hole 18 has a cross section shape corresponding to the cross section shape of one of the first shaft 31, the second shaft 32, the third shaft 33 and the fourth shaft 34 so as to synchronously move the first base 10 and the second base 20.

Figure 3:
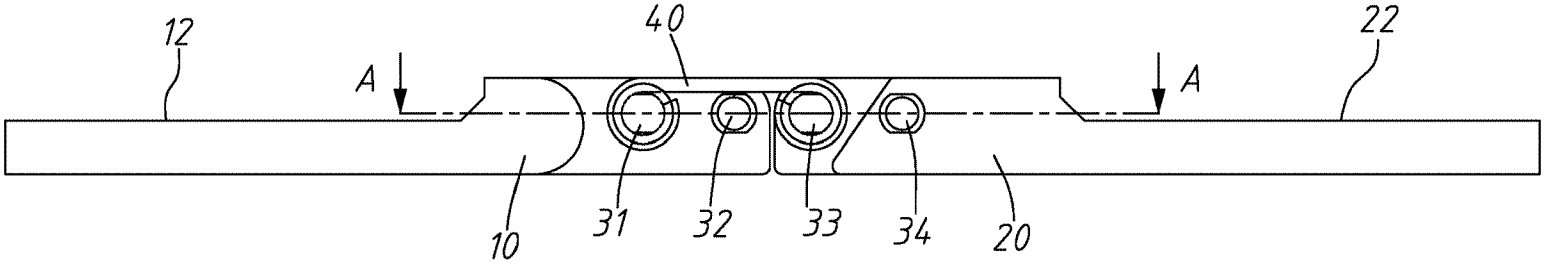
FIG. 3 is a front view of FIG. 1.
Figure 5:
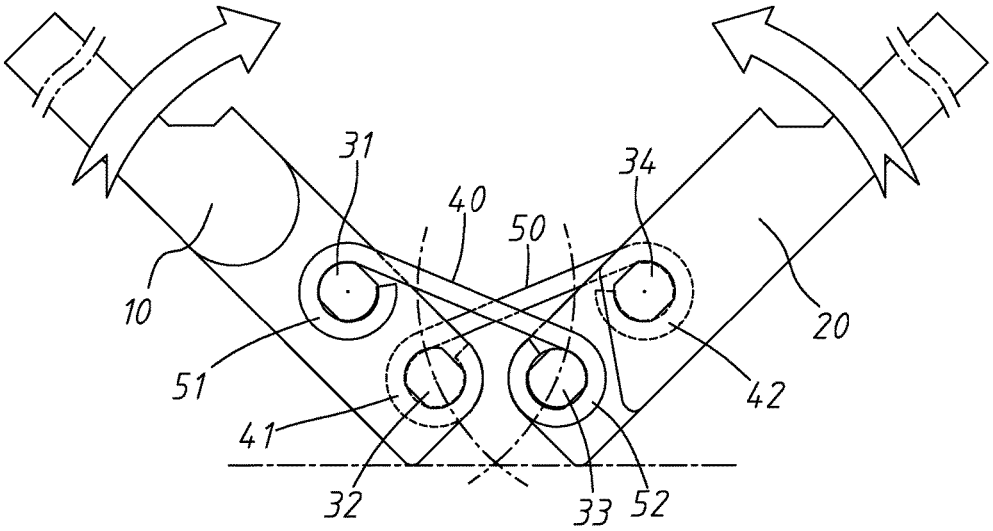
FIG. 5 depicts the synchronous hinge device of FIG. 3 which begins to open.
Figure 6:
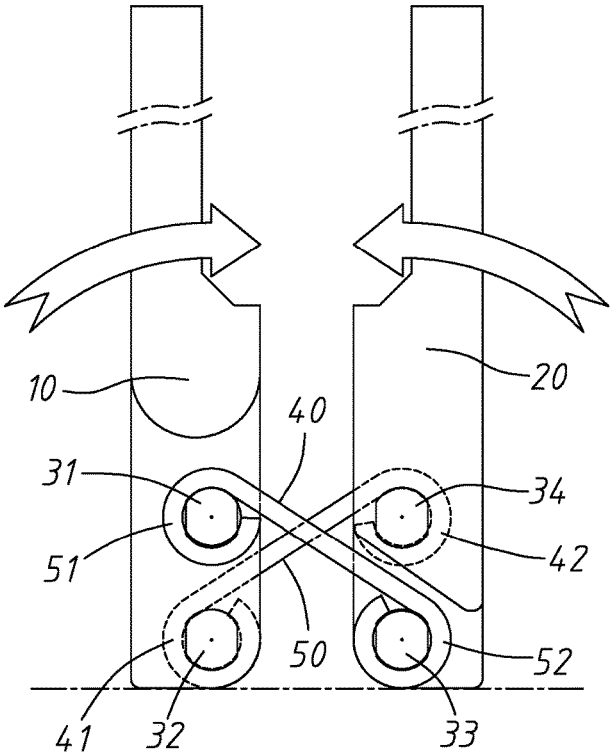
FIG. 6 depicts the synchronous hinge device of FIG. 5 which is already opened.

When the synchronous hinge device of the invention is opened from the condition shown in FIG. 3 along directions of arrows shown in FIG. 5, the first shaft 31, the second shaft 32, the third shaft 33 and the fourth shaft 34 rotate to positions of different radial length to generate torque to position the first base 10 and the second base 20 at any angle due to the distance constrain caused by the axle sleeves 41, 42, 51 and 52. FIG. 6 shows synchronous hinge device in a closed condition wherein the first base 10 and the second base 20 are parallel.

Figures 7, 7A:
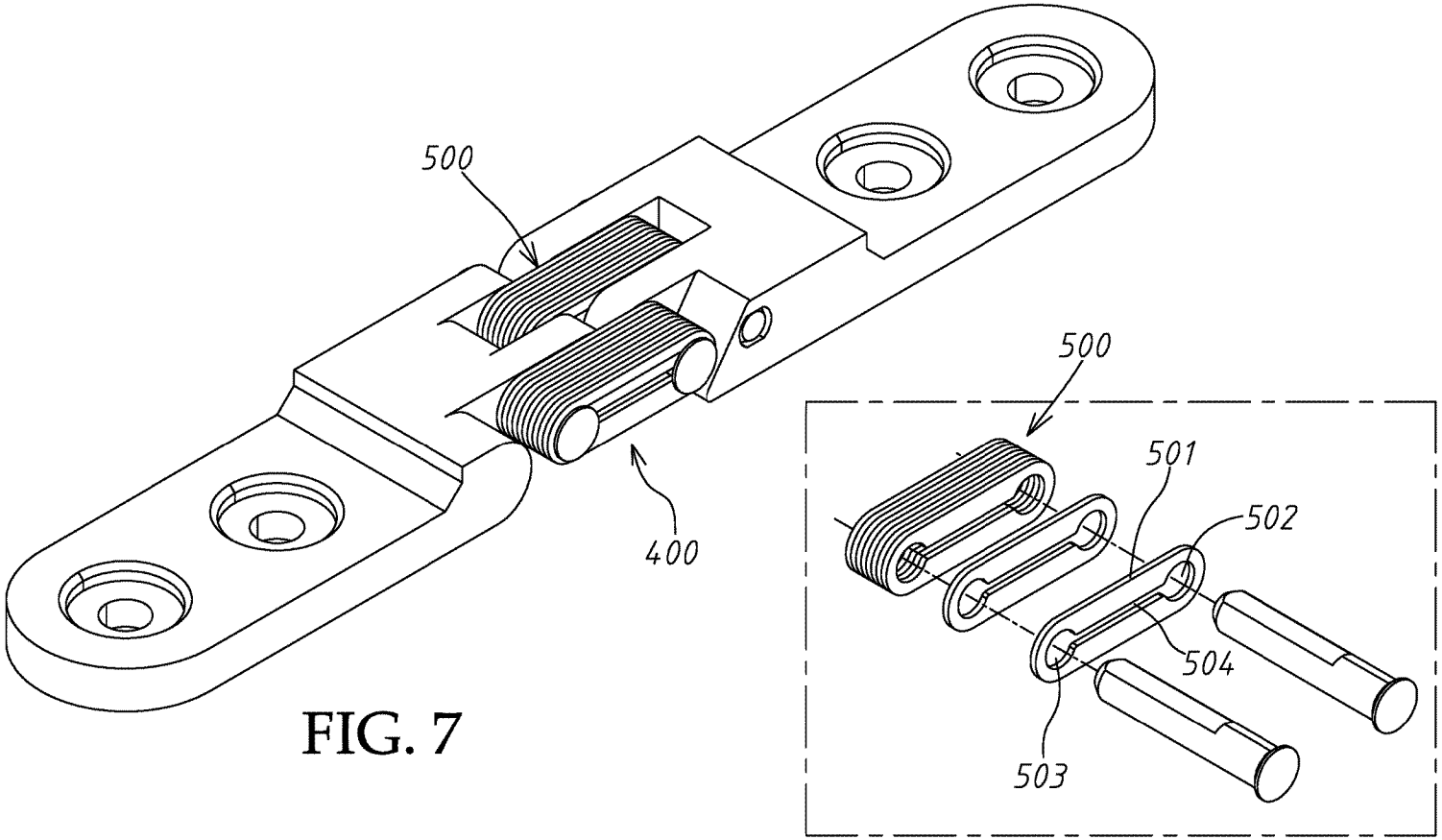
FIG. 7 is a perspective view of another embodiment of a synchronous hinge device of the invention.
FIG. 7A is a partially exploded and enlarged view of FIG. 7.

Referring to FIGS. 7 and 7A, another embodiment of the synchronous hinge device of the invention is shown. In this embodiment, each of the first torque element 400 and the second torque element 500 includes a plurality of closed sealing sheets 501. Each of the closed sealing sheets 501 includes two separated through holes 502 and 503 and a groove 504 connecting the separated through holes 502 and 503.

Figures 8, 8A:
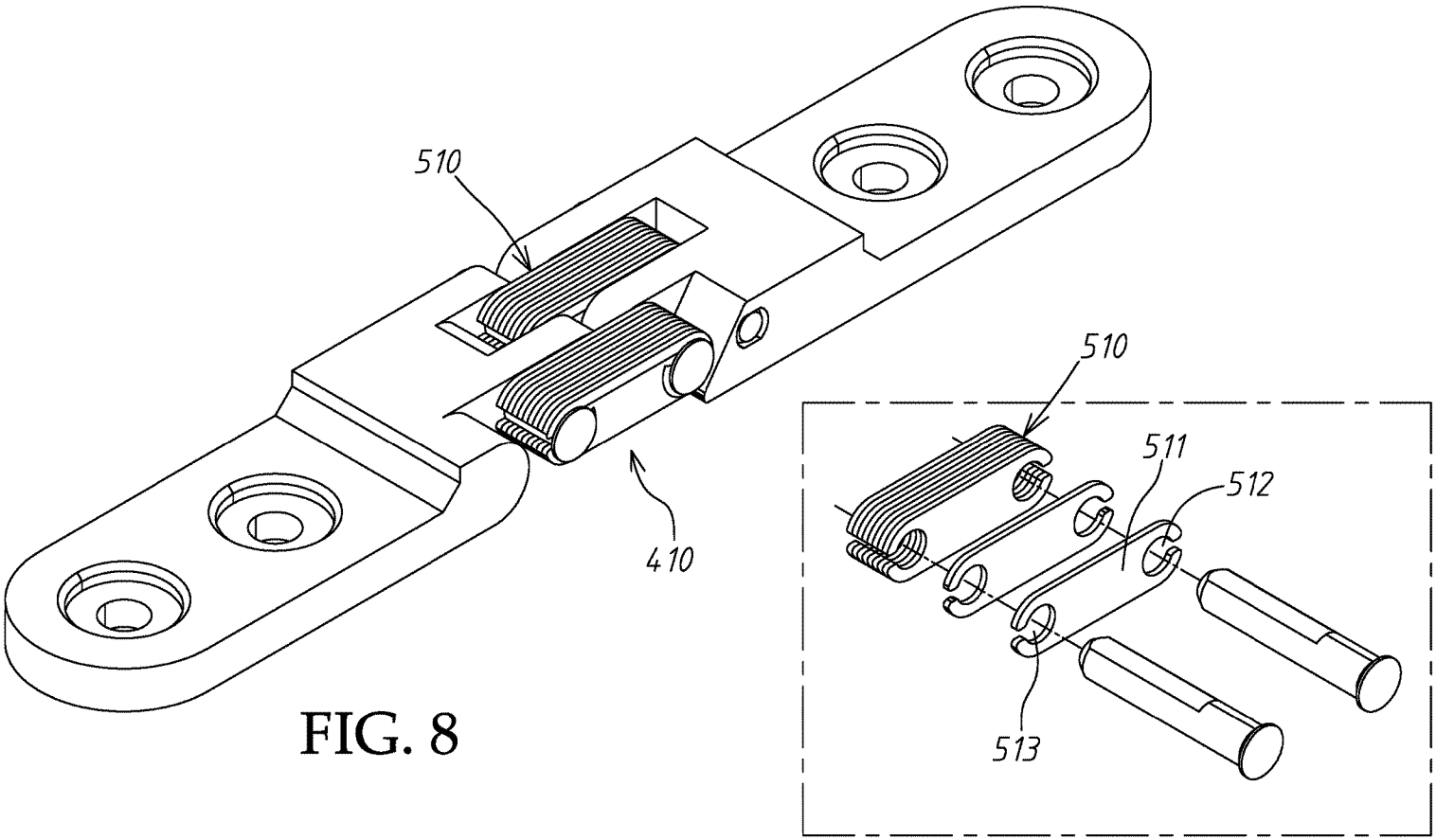
FIG. 8 is a perspective view of another embodiment of a synchronous hinge device of the invention.
FIG. 8A is a partially exploded and enlarged view of FIG. 8.

Referring to FIGS. 8 and 8A, another embodiment of the synchronous hinge device of the invention is shown. In this embodiment, each of the first torque element 410 and the second torque element 510 includes a plurality of opened sealing sheets 511. Each of the opened sealing sheets 511 includes two separated through holes 512 and 513 which are connected to an outer edge of the opened sealing sheets 511.

In another embodiment, each of the first torque element and the second torque element includes a plurality of closed sealing sheets 501 of FIGS. 7 and 7A and a plurality of opened sealing sheets 511 of FIGS. 8 and 8A.

Figure 9:
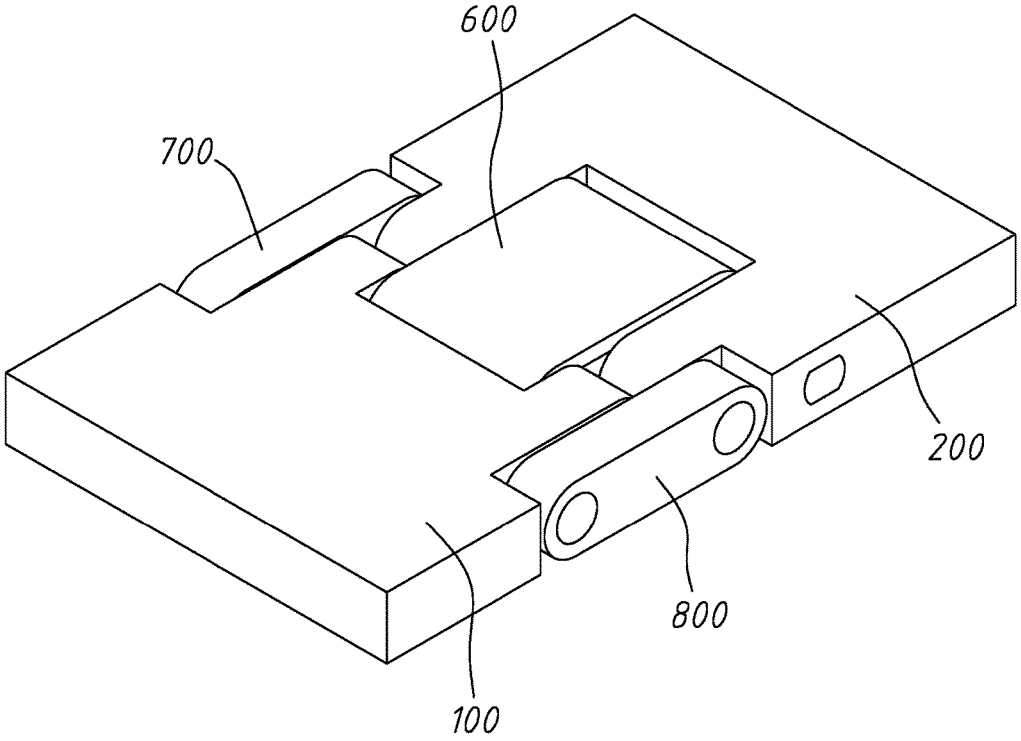
FIG. 9 is a perspective view of another embodiment of a synchronous hinge device of the invention.
Figure 10:
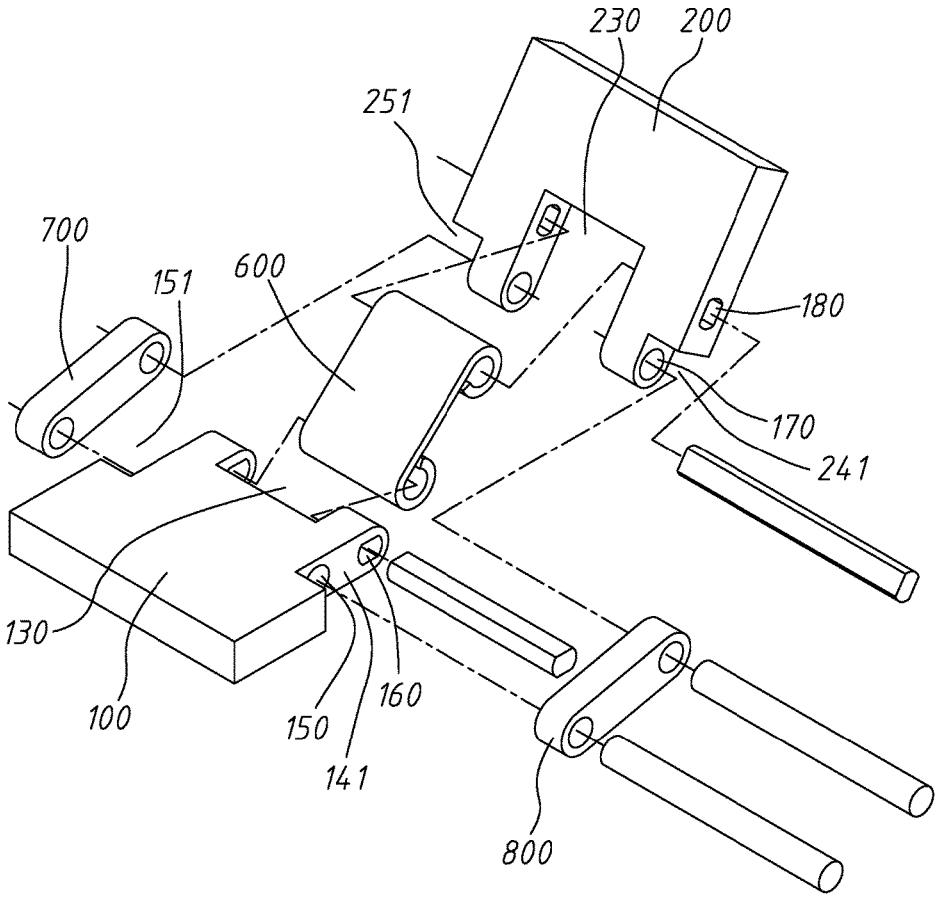
FIG. 10 is an exploded view of FIG. 9.
Figure 11:
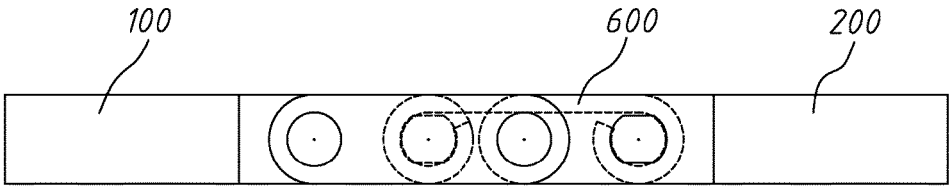
FIG. 11 is a front view of FIG. 10.
Figure 12:
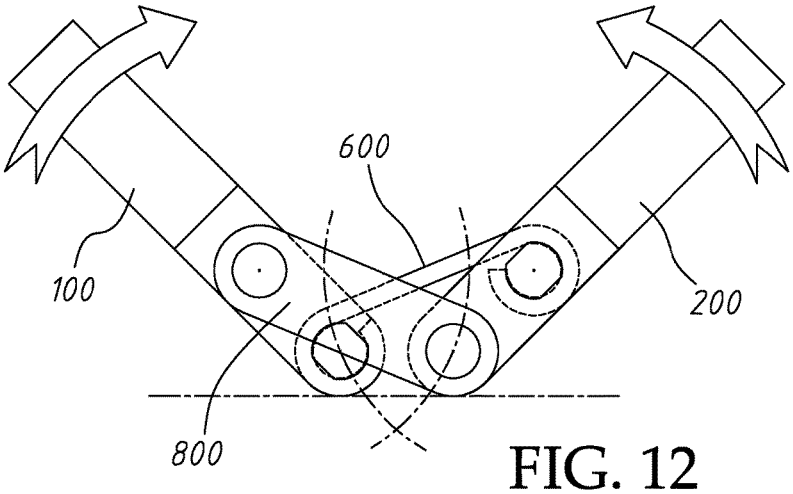
FIG. 12 depicts the synchronous hinge device of FIG. 11 which begins to open.
Figure 13:
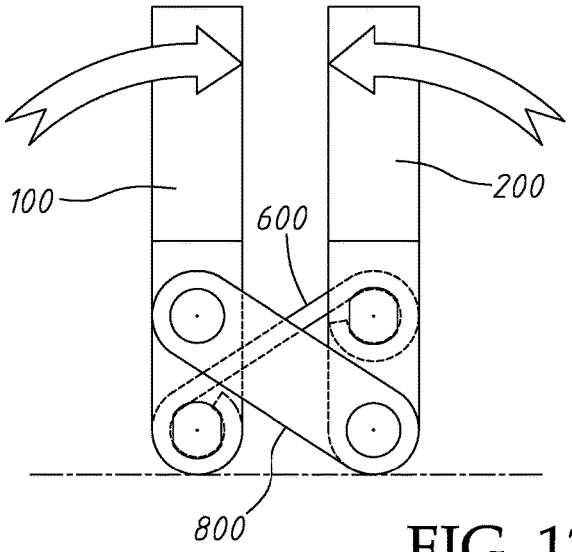
FIG. 13 depicts the synchronous hinge device of FIG. 12 which is already opened.

Referring to FIGS. 9 and 10, another embodiment of the synchronous hinge device of the invention is shown. The synchronous hinge device includes a first base 100 and a second base 200. The first base 100 includes a first central groove 130 and two first outer grooves 141 and 151. The second base 200 includes a second central groove 230 and two second outer grooves 241 and 251. The synchronous hinge device further includes a torque element 600 disposed in the first central groove 130 and the second central groove 230 and connecting the second through hole 160 and the fourth through hole 180, a link 700 disposed in the first outer groove 151 and the second outer groove 251 and connecting the first through hole 150 and the third hole 170 and a link 800 disposed in the first outer groove 141 and the second outer groove 241 and connecting the first through hole 150 and the third hole 170. As shown in FIGS. 11 to 13, the first base 100 and the second base 200 can be positioned at any angle through the torque element 600 which generates torque due to the geometry constrain.

The synchronous hinge device of the invention can be positioned at any angle through geometry constrain without using complicated concave and convex wheels and other torque elements. Therefore the cost and labor for manufacturing are reduced. The synchronous hinge device of the invention provides a faster and smoother operation.

While the invention has been described by way of example and in terms of preferred embodiment, it is to be understood that the invention is not limited thereto. To the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. A synchronous hinge device, comprising:

a first base comprising a first connecting portion and a first assembling portion, the first connecting portion comprises a first central groove, a first outer groove, a first through hole and a second through hole, the first through hole and the second through hole are located adjacent to the first central groove and the first outer groove;

a second base comprising a second connecting portion and a second assembling portion, the second connecting portion comprises a second central groove, a second outer groove, a third through hole and a fourth through hole, the third through hole and the fourth through hole are located adjacent to the second central groove and the second outer groove;

a first shaft extending through the first through hole;

a second shaft extending through the second through hole;

a third shaft extending through the third through hole;

a fourth shaft extending through the fourth through hole;

a first torque element disposed between the first shaft and the third shaft and corresponding to a first distance between the first and third shafts; and a second torque element disposed between second shaft and the fourth shaft and corresponding to a second distance between the second and fourth shafts, wherein the first torque element comprises axle sleeves limiting the first distance and so as to synchronously move the first base and the second base, and the second torque element comprises axle sleeves limiting the second distance and so as to synchronously move the first base and the second base.

2. The synchronous hinge device as claimed in claim 1, wherein the axle sleeves are formed at two ends of the first and second torque elements and have a curved shape and a notch.

3. The synchronous hinge device as claimed in claim 1, wherein the first shaft, the second shaft, the third shaft and the fourth shaft have different radial length in a predetermined position.

4. The synchronous hinge device as claimed in claim 3, wherein each of the first shaft, the second shaft, the third shaft and the fourth shaft has an upper cut plane and a lower cut plane, a distance between the upper cut plane and the lower cut plane is less than the radial length of an outer periphery thereof, and at least one of the first through hole, the second through hole, the third through hole and the fourth through hole has a cross section the same as a cross section of one of the first shaft, the second shaft, the third shaft and the fourth shaft.

5. The synchronous hinge device as claimed in claim 1, wherein each of the first torque element and the second torque element comprises a plurality of closed sealing sheets, and each of the closed sealing sheets comprises two separated through holes and a groove connecting the separated through holes.

6. The synchronous hinge device as claimed in claim 1, wherein each of the first torque element and the second torque element comprises a plurality of opened sealing sheets, and each of the opened sealing sheets comprises two separated through holes connecting to an outer edge thereof.

7. The synchronous hinge device as claimed in claim 1, wherein each of the first torque element and the second torque element comprises a plurality of closed sealing sheets and a plurality of opened sealing sheets, each of the closed sealing sheets comprises two separated through holes and a groove connecting the separated through holes, and each of the opened sealing sheets comprises two separated through holes connecting to an outer edge thereof.

* * * * *